US005572740A

United States Patent [19]

Geniesse

[11] Patent Number: 5,572,740

[45] Date of Patent: Nov. 12, 1996

[54] BEAUTICIAN'S CAPE

[76] Inventor: Rosalind Geniesse, 486-A Longview Dr., Harrisonburg, Va. 22801

[21] Appl. No.: 517,431

[22] Filed: Aug. 21, 1995

[51] Int. Cl.[6] ..... A41D 27/12

[52] U.S. Cl. ..... 2/46; 2/50

[58] Field of Search ..... 2/46, 48, 49.1, 2/49.4, 49.5, 50, 51, 53, 60, 88, 104, 135, 912, 913, 916; 4/515, 520

[56] References Cited

U.S. PATENT DOCUMENTS

| | | | |
|---|---|---|---|
| 797,434 | 8/1905 | Homeyer | 2/49.4 |
| 1,216,088 | 2/1917 | De Vingo | 2/50 |
| 1,251,127 | 12/1917 | Squier | 2/50 |
| 1,556,468 | 10/1925 | Alamo | 2/50 |
| 1,974,237 | 9/1934 | Eidinger | 2/50 |
| 4,797,952 | 1/1989 | Petrini | 2/50 |
| 5,432,952 | 7/1995 | Tate | 2/49.4 |

*Primary Examiner*—C. D. Crowder
*Assistant Examiner*—Gloria Hale

[57] ABSTRACT

A garment for protecting clothing worn by a person is disclosed. The garment comprises two flaps connected to a band in opposition to one another, and a fastener for closing the band. The flaps each comprise at least one liquid absorbent layer superimposed on and substantially coextensive with a substantially liquid impermeable layer. The band comprises two liquid absorbent layers superimposed on and substantially coextensive with a substantially liquid impermeable layer sandwiched therebetween. In use, one of the flaps is tucked between the clothing and the wearer with the other flap left on the outside of the clothing, and the band is fastened about the wearer to hold the protective garment in place. The garment is particularly useful as a beautician's cape where it provides excellent protection from chemicals used in treating hair.

16 Claims, 3 Drawing Sheets

BEAUTICIAN'S CAPE

BACKGROUND OF THE INVENTION

1. Field of the Invention

The present invention relates to garments for protecting clothing worn by a person. More particularly, the present invention relates to a lightweight, launderable beautician's cape for use during the processing of hair.

2. The Prior Art

During the processing of hair, which includes washing, coloring, and perming, beauticians routinely use towels tucked into the neckline of the customer's clothing to absorb excess liquid dripping down the customer's neck. Sometimes the liquid penetrates the towel to wet and stain the clothing and/or irritate the customer's skin. Most beauticians recommend that their customers who are having their hair permed or colored either wear old clothes or change into a smock to prevent clothing damage from the chemicals used in hair coloring and perming. The smocks are made from a variety of materials, such as fine denier fabrics woven from nylon or cotton/polyester blends, which absorb liquid to a certain extent. Many customers, however, prefer not to change into smocks since they are not always washed after every use. It is also inconvenient to have to carry along a change of clothing to the beauty parlor.

It would therefore be desirable to have a beautician's garment that replaces the use of towels while simultaneously protecting the customer's clothing and skin against chemicals during hair processing. It would be an added advantage for this garment to be re-usable rather than disposable, and thus, to substantially retain its shape and function after laundering. The present invention achieves all of these objectives in a garment which is also lightweight and comfortable.

U.S. Pat. No. 3,857,116 to Meeker teaches a method of making towel bibs with absorbent material. The bibs are made with a protective flap bordering the rectangular neck opening. The protective flap is tucked beneath the clothing of the wearer, in contact with the skin of the wearer, to hold the towel bib in place and to protect the inside of the clothing from moisture dripping down the neck, while the main body of the towel bib covers and protects the outside of the clothing. These bibs are comparable to the towels currently used by beauticians and therefore suffer from the same deficiencies, i.e., the liquid can still penetrate the absorbent, towel material to wet and stain the clothing and/or irritate the wearer's skin. Furthermore, little or no protection is afforded the back or shoulders of the wearer.

U.S. Pat. No. 5,100,710 to Rizzuto teaches a disposable bib comprising a sheet-like substrate formed from a first liquid absorbent layer and a second nonabsorbent layer. The absorbent layer faces away from the user while the nonabsorbent layer faces the user to keep the user dry. In one embodiment (FIGS. 1–3) the only protection afforded the back or shoulders of the wearer is the neck tying portion; in the other embodiment where the bib is pulled on overhead, there is no provision for pulling the bib snugly around the neck of the wearer to prevent liquid entering under the bib. Neither embodiment protects the inside of the clothing.

U.S. Pat. No. Des. 340,795 to Matthews shows a multi-fitting protective hairdressing shield. Advertising literature for this shield indicates it is made of rubber, which is heavy and nonabsorbent, and depicts its use over a smock or cape, which suffers from the disadvantages previously set forth.

Furthermore, the shield is not adaptable for use with certain clothing necklines, for example, turtlenecks.

The protective garment of the present invention overcomes these deficiencies of the prior art.

SUMMARY OF THE INVENTION

This invention provides a garment for protecting clothing worn by a person. The garment comprises a first flap, a second flap, a band, and a fastener for closing the band. The flaps each comprise at least one liquid absorbent layer superimposed on and substantially coextensive with a substantially liquid impermeable layer. The band comprises two liquid absorbent layers superimposed on and substantially coextensive with a substantially liquid impermeable layer sandwiched therebetween. The flaps are connected to the band in opposition to one another with the liquid absorbent layer forming an exterior surface of each flap.

In a preferred embodiment, the present invention provides a beautician's cape, comprising a first outer flap, a second inner flap, a collar, and a fastener for closing the collar. The flaps each comprise at least one liquid absorbent fabric layer superimposed on and substantially coextensive with a substantially liquid impermeable polyethylene film layer. The collar comprises two liquid absorbent fabric layers between which a substantially liquid impermeable polyethylene film layer is sandwiched. The flaps are connected to the collar in opposition to one another with the liquid absorbent layer of the first outer flap forming an exterior surface thereof when the collar is closed. The cape is re-usable laundering.

The garments of this invention have utility in beauty salons as well as in hospitals and nursing homes. The advantages are numerous: the garment shields the wearer's clothing against wetness and stains while protecting the skin from irritating chemicals; the wearer no longer needs to change into old clothes or a smock for protection; and the garment launders under substantially the same conditions as towels without adverse effect to permit re-use.

BRIEF DESCRIPTION OF THE DRAWINGS

The invention will be more fully understood and further advantages will become apparent when reference is made to the following drawing figures and the accompanying description of the preferred embodiments wherein.

DESCRIPTION OF THE PREFERRED EMBODIMENTS

The description which follows will focus primarily on capes which fasten around the wearer's neck to protect clothing on the upper torso. However, this is not meant to preclude protection for other parts of the body and other clothing. Therefore, upon first usage, the garment will be referred to generically as a protective garment, and the part thereof which fastens the garment on the wearer will be referred to as a band; thereafter, the garment will be referred to as a cape, and the band will be referred to as a collar.

Figure 1:
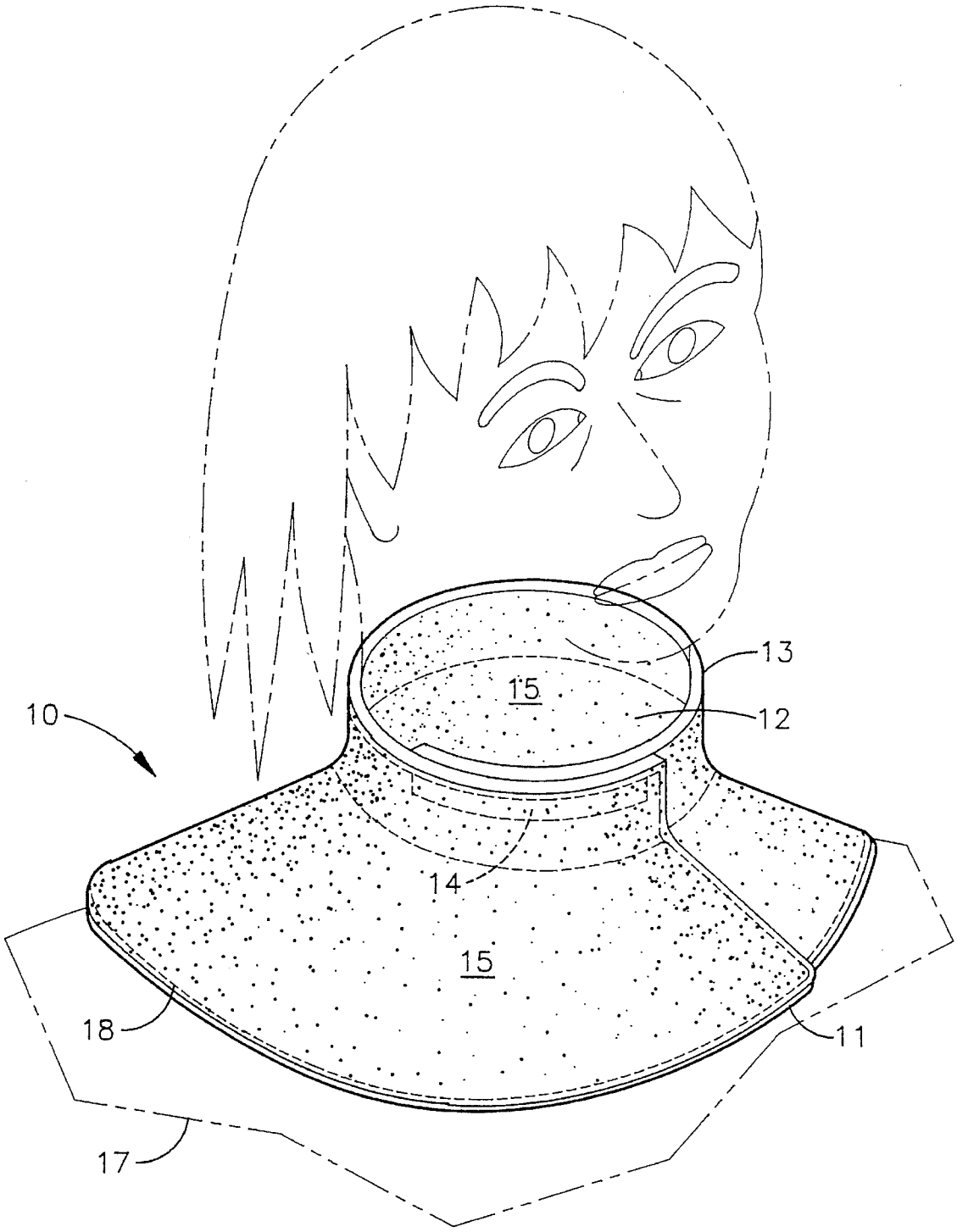
FIG. 1 is a front perspective view of a closed protective garment 10 according to the present invention.
Figure 2:
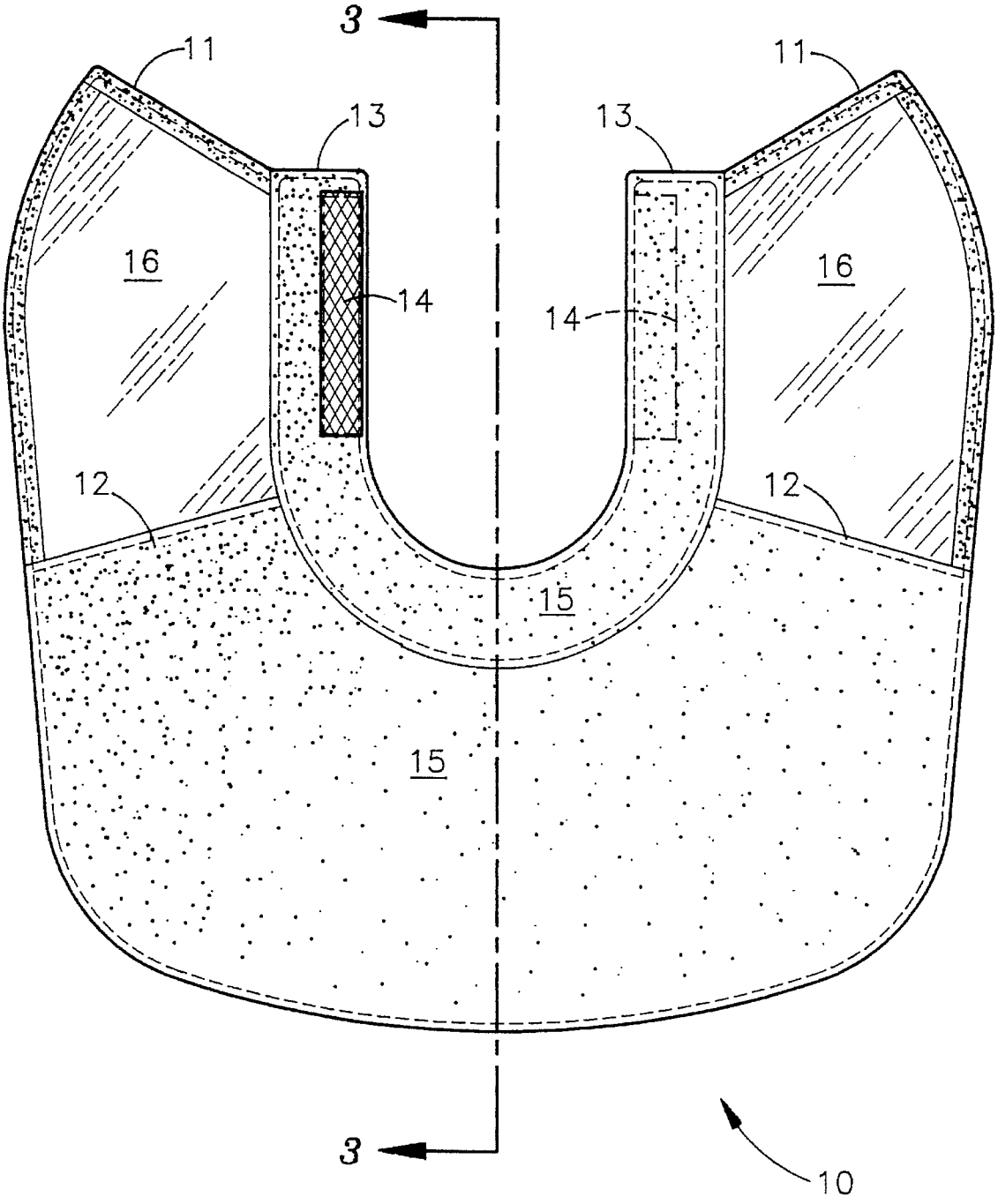
FIG. 2 is a plan view of the open protective garment 10 of FIG. 1 with flap 12 lying on flap 11.

With reference to FIGS. 1 and 2, the preferred protective garment is a cape 10 comprising a first flap 11, a second flap 12, a band 13, and a fastener 14. Band 13 is a collar which is placed about the wearer's neck and connected with a conventional fastener 14 in the front. Fastener 14 may be snaps, a hook and eye, a button closure, tie strips, and/or hook and loop fabric fasteners such as VELCRO® fasteners (where one surface is covered with hook-type separable fastener structure and the opposing surface is covered with loop-type separable fastener structure). The hook and loop fabric fastener 14 depicted in FIG. 1 is preferred since it permits a snug yet comfortable fit which maximizes efficiency of cape 10. If collar 13 is too loose, then liquid may drip or seep inside of cape 10.

Figure 3:
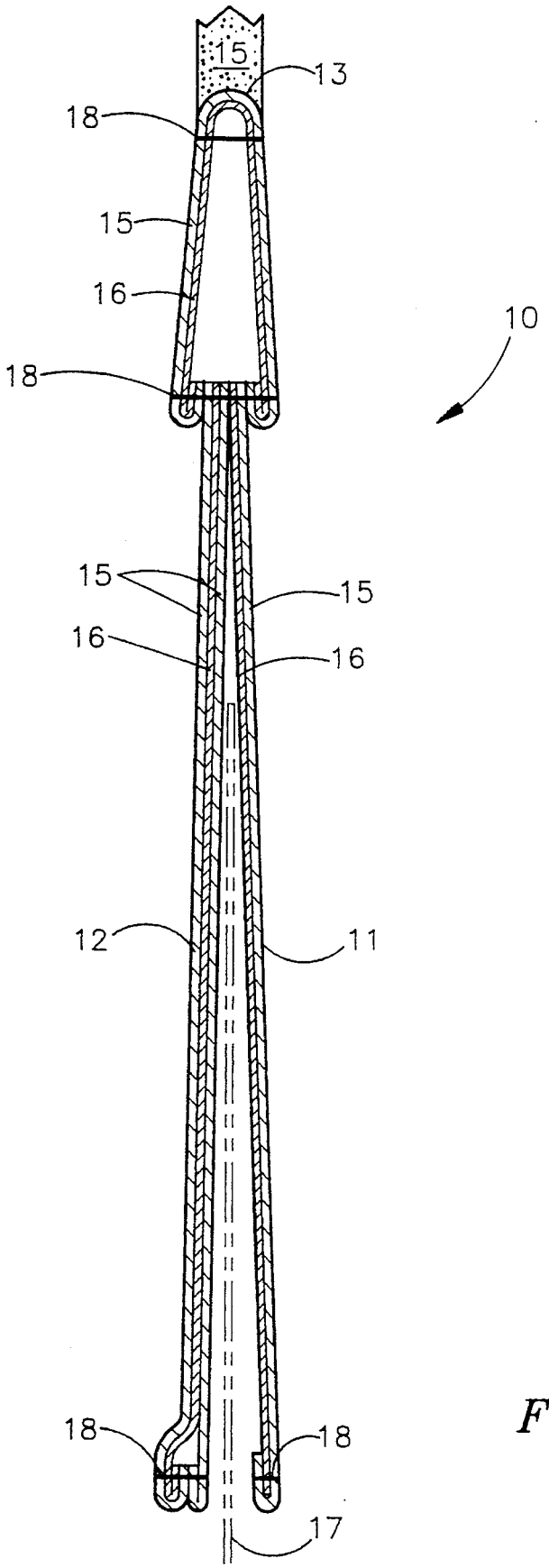
FIG. 3 is a section view through section line 3—3 of FIG. 2, showing the band 13 and flaps 11 and 12 of the preferred embodiment of the present invention in relation to the wearer's clothing 17.

With reference to FIG. 3, collar 13 comprises two liquid absorbent layers 15 superimposed on and substantially coextensive with a substantially liquid impermeable layer 16 sandwiched therebetween. Flaps 11 and 12 each comprise at least one liquid absorbent layer 15 superimposed on and substantially coextensive with a substantially liquid impermeable layer 16. Flaps 11 and 12 are connected to collar 13 in opposition to one another with their liquid absorbent layers 15 forming exterior surfaces thereof when collar 13 is closed in place around the wearer's neck (see FIG. 1). The number of layers forming flaps 11 and 12 and collar 13 is unlimited as long as flaps 11 and 12 and collar 13 are sufficiently flexible to permit normal function. This means that inner flap 12 can be tucked inside clothing 17 worn by a customer and outer, protective flap 11 drapes to sufficiently cover the desired portions of the wearer's clothing. Collar 13 must be flexible enough to permit a snug fit without gapping at the wearer's neck.

It is critical to the present invention that collar 13 comprises two absorbent layers 15 sandwiching liquid impermeable layer 16. Layer 15 adjacent to the wearer's neck absorbs moisture dripping down the wearer's neck that might seep inside collar 13.

While flaps 11 and 12 may be constructed using a single liquid absorbent layer 15, multiple layers may also be used depending upon the degree of absorbency and flexibility desired. Inner flap 12 preferably comprises at least two liquid absorbent layers 15 which sandwich the substantially liquid impermeable layer 16. One of these layers is adjacent the wearer's skin to make cape 10 more comfortable to wear. It also functions to absorb any drips that might leak or seep to the inside of cape 10 if collar 13 is at all loose. The outer flap 11 preferably comprises a single liquid absorbent layer 15 superimposed on and substantially coextensive with a single substantially liquid impermeable layer 16. Outer flap 11 will typically be longer than inner flap 12. Its length is a matter of choice. Inner flap 12 functions to protect the inside of clothing 17 by absorbing any drips that are not absorbed by collar 13.

By layer is meant a shaped article such as a film (sheet), tape, or a network of fiber or tape. By network is meant tapes or fibers arranged in configurations of various types. For example, a plurality of fibers can be grouped together to form a twisted or untwisted yarn. The fibers of yarn may be formed as a felt, knitted or woven into a fabric, fabricated into a non-woven fabric, or formed into a fabric by any of a variety of conventional techniques.

A network of fibers is preferably used as the liquid absorbent layer or layers. Preferred fabric constructions are woven fabrics, especially terry cloth, and knitted fabrics. Natural fibers, synthetic fibers and blends thereof may be used. Preferred fibers for the liquid absorbent layer are cotton and cotton blends, especially a cotton/polyester blend.

A plastic film or sheet is preferably used as the substantially liquid impermeable layer or layers. Thickness of the film may vary. It must, however, be thick enough to survive construction and standard use conditions without ripping or tearing, and it must be thin enough to retain acceptable flexibility of the final product. The preferred film thickness ranges from about 0.1 mil up to about 10 mils, with about 0.5 to 2 mils being more preferred. Films which may be used in the present invention include polyolefinic films, polyvinyl chloride films, polystyrene films and multilayer films. Homopolymers or copolymers of these films can be used. Useful polyolefinic films include those of polyethylene and polypropylene and copolymers thereof. A polyethylene film or sheet is most preferred.

In collar 13, layers 15 and 16 are connected with little freedom of movement relative to one another. In flaps 11 and 12, however, it is only critical that the layers be connected at collar 13—the layers may hang free of one another from collar 13. It is nonetheless preferred that the layers within each of flaps 11 and 12 be connected so that the layers of the individual flaps do not hang free of one another from collar 13.

The film may be connected to the absorbent layer or layers in a variety of ways. By way of example, it may be adhered thereto by the application of heat and/or pressure (fusion bonding); a heat- or pressure-sensitive adhesive can be used between the film and the absorbent layer followed by heat or pressure as appropriate; stitches may be used to hold the layers together. Stitches 18 are the preferred manner of connecting the layers together within flaps and the collar. The layers may be continuously connected, spot connected, or peripherally connected to one another across their coextensive surfaces. They are preferably joined along their boundaries.

It is crucial to the success of the present invention that collar 13 include a substantially liquid impermeable layer 16. When a cape 10 was constructed and used during hair coloring with collar 13 consisting only of two liquid absorbent layers, the hair color seeped through the collar to stain the absorbent layer 15 of inner flap 12. This means that the wearer's clothing would have been stained.

Cape 10 can be laundered for re-use by utilizing the hot or cold cycles of a conventional washing machine, preferably the cold cycle, and the hot cycle of a conventional dryer. The temperature of the hot water cycle of a washing machine varies with the temperature setting of the hot water heater, but typical temperatures would be in the range of about 120° to 160° F. The dryer temperature would be up to about 150° F.

In use, inner flap 12 is tucked inside the wearer's clothing 17 (e.g., a blouse or shirt) and outer flap 11 is draped protectively over the outside of the wearer's clothing 17. Collar 13 is fastened around the neck under the chin with fastening strips 14. A conventional beautician's cape that fastens in the back may then be placed over cape 10, with collar 13 exposed, and fastened in place.

The cape of the preferred embodiment is constructed as follows. The collar comprises a rectangular length of terry cloth and an identically sized length of polyethylene sheet. The terry cloth preferably is all cotton and can be purchased at any piece goods shop. The polyethylene sheet is 0.9 mil thick (e.g., drop cloth, Model #46020 (200), made by Hyde Mfg. Co.). The rectangular polyethylene sheet is basted to the underside of the rectangular terry cloth.

For the inner flap, two identical pieces of terry cloth are cut and one piece of polyethylene sheet is cut. The polyethylene sheet is pinned or basted to the underside of one of the terry cloth pieces. Then the two terry cloth pieces (one with the polyethylene sheet attached) are sewn with their right sides together at the periphery (not at the neck). The terry cloth pieces are turned right side out and stitched 0.25 inch from the joint seam to help secure the polyethylene sheet therebetween. The piece is also stitched around the neck to help secure the polyethylene sheet to the terry cloth pieces for subsequent attachment to the collar.

To make the large outer flap, a flap of polyethylene sheet is sewn or basted to the underside of a flap of terry cloth of the same size. The terry cloth is turned 0.25 inch onto the polyethylene sheet at the periphery to make a bound edge on the polyethylene sheet side of the flap.

The neck of the large outer flap is attached to the open collar rectangle by sewing the two with right sides facing one another (terry side of collar facing terry side of flap). The neck of the smaller inner flap is attached to the opposite side of the open collar rectangle in a similar fashion. The collar rectangle is evenly folded on itself with the polyethylene sheet side exposed. The ends of the folded rectangle are sewn and the collar is turned to expose the terry side. The collar now comprises two absorbent terry layers and two nonabsorbent polyethylene layers due to folding of the material on itself. The two seams joining the flaps to the collar are stitched together. The turned collar is edged with a seam about 0.25 inch from the sides. The stitching is necessary to hold the polyethylene sheet in place in the collar. Cooperating VELCRO fasteners are then sewn to opposing sides of the collar.

This cape replaces the towels typically used during processing of hair. Although the cape may be made long enough to eliminate the need for another cape, for reasons of economy it is preferred that the cape essentially cover the shoulders and upper back and that a second conventional. beautician's cape be used over the flaps of the cape of the invention, leaving the collar exposed.

While the preferred embodiments of the invention have been set forth above, it will be understood that various modifications can be made thereto without departing from the spirit and scope of the invention claimed.

I claim:

1. A garment for protecting clothing worn by a person, comprising a first flap, a second flap, a band, and a fastener for closing the band; the flaps each comprising at least one liquid absorbent layer superimposed on and substantially coextensive with a substantially liquid impermeable layer; the band comprising two liquid absorbent layers between which a substantially liquid impermeable layer is sandwiched; the flaps being connected to the band in opposition to one another with the liquid absorbent layer of each flap forming an exterior surface thereof.

2. The garment of claim 1 wherein the second flap comprises two liquid absorbent layers between which the substantially liquid impermeable layer is sandwiched.

3. The garment of claim 1 wherein each of the substantially liquid impermeable layers comprises a film having a thickness of up to about 10 mils.

4. The garment of claim 3 wherein the film is selected from the group consisting of a polyvinyl chloride film, a polyolefin film, and a polystyrene film.

5. The garment of claim 3 wherein the film is a polyethylene film.

6. The garment of claim 1 wherein each of the substantially liquid impermeable layers comprises a film selected from the group consisting of a polyvinyl chloride film, a polyolefin film, and a polystyrene film.

7. The garment of claim 1 wherein each of the substantially liquid impermeable layers comprises a polyethylene film.

8. The garment of claim 1 further characterized by being re-usable after laundering.

9. The garment of claim 1 wherein the layers of the first flap are bound together, wherein the layers of the second flap are bound together, and wherein the layers of the band are bound together.

10. The garment of claim 9 wherein the layers are bound together by a plurality of stitches.

11. A beautician's cape, comprising a first outer flap, a second inner flap, a collar, and a fastener for closing the collar; the flaps each comprising at least one liquid absorbent fabric layer superimposed on and substantially coextensive with a substantially liquid impermeable polyethylene film layer; the collar comprising two liquid absorbent fabric layers between which a substantially liquid impermeable polyethylene film layer is sandwiched; the flaps being connected to the collar in opposition to one another with the liquid absorbent layer of the first outer flap forming an exterior surface thereof when the collar is closed; said cape being re-usable after laundering.

12. The cape of claim 11 wherein the second inner flap comprises two liquid absorbent fabric layers between which the polyethylene film layer is sandwiched.

13. The cape of claim 12 wherein the layers of the first flap are bound together, wherein the layers of the second flap are bound together, and wherein the layers of the collar are bound together.

14. The cape of claim 13 wherein the layers are bound by a plurality of stitches and wherein the first and second flaps are connected to the collar by a plurality of stitches.

15. The cape of claim 14 wherein the liquid absorbent fabric layer comprises a cotton or cotton blend terry cloth.

16. The cape of claim 14 wherein the liquid absorbent fabric layer comprises a cotton or cotton blend knit fabric.

* * * * *